US006877833B2

(12) United States Patent
Teshigawara et al.

(10) Patent No.: US 6,877,833 B2
(45) Date of Patent: Apr. 12, 2005

(54) PRINTING DATA PRODUCING METHOD FOR PRINTING APPARATUS

(75) Inventors: Minoru Teshigawara, Kanagawa (JP); Naoji Otsuka, Kanagawa (JP); Hitoshi Sugimoto, Kanagawa (JP); Kiichiro Takahashi, Kanagawa (JP); Hitoshi Nishikori, Tokyo (JP); Osamu Iwasaki, Tokyo (JP); Takeshi Yazawa, Kanagawa (JP); Toshiyuki Chikuma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 10/057,901

(22) Filed: Jan. 29, 2002

(65) Prior Publication Data

US 2002/0105557 A1 Aug. 8, 2002

(30) Foreign Application Priority Data

Jan. 31, 2001 (JP) ..... 2001-024548

(51) Int. Cl.[7] ..... B41S 2/205
(52) U.S. Cl. ..... 347/15; 347/43; 358/1.9
(58) Field of Search ..... 347/15, 43, 40, 347/41, 12, 10; 358/1.2, 1.9, 1.13, 501, 515, 518, 521, 534

(56) References Cited

U.S. PATENT DOCUMENTS 5,648,801 A 7/1997 Beardsley et al.
5,975,673 A 11/1999 Ohtsuka et al.
6,030,065 A * 2/2000 Fukuhata ..... 347/15
6,089,697 A 7/2000 Tajika et al.
6,120,129 A 9/2000 Iwasaki et al.
6,120,141 A 9/2000 Tajika et al.
6,149,260 A 11/2000 Minakuti
6,312,096 B1 11/2001 Koitabashi et al.
6,390,586 B1 * 5/2002 Takahashi et al. ..... 347/19
6,540,326 B2 * 4/2003 Matsubara et al. ..... 347/41

FOREIGN PATENT DOCUMENTS

EP 0 958 924 11/1999

OTHER PUBLICATIONS

U.S. Appl. No. 09/324,653, filed Jun. 3, 1999, Yazawa.
U.S. Appl. No. 09/768,464, filed Jan. 25, 2001, Otsuka et al.

* cited by examiner

*Primary Examiner*—Lamson Nguyen
(74) *Attorney, Agent, or Firm*—Fitzpatrick, Cella, Harper & Scinto

(57) ABSTRACT

A printing apparatus can reduce degradation in print quality of a printed image, notably in a highlight portion or an intermediate gradation portion, in the case where the image is printed by forming dots of a plurality of sizes. Specifically, data causing larger and smaller cyan ink droplets, respectively, to be ejected is independently subjected to a conversion to n-value process. Thus, the data for larger ink droplets is present in a portion of printing data which corresponds to the highlight portion or intermediate gradation portion of the image. During printing, larger dots are formed in this area, thereby making it difficult to perceive possible stripes caused by the offset of the positions at which smaller droplets impact a sheet.

16 Claims, 12 Drawing Sheets

LEVEL 0
BIT SIGNAL: 0000

LEVEL 1
BIT SIGNAL: 0001

LEVEL 2
BIT SIGNAL: 0010

LEVEL 3
BIT SIGNAL: 0011

LEVEL 4
BIT SIGNAL: 0100

PRINTING DATA PRODUCING METHOD FOR PRINTING APPARATUS

This application is based on Patent Application No. 2001-024548 filed Jan. 31, 2001 in Japan, the content of which is incorporated hereinto by reference.

BACKGROUND OF THE INVENTION

1. Field of the Invention

The present invention relates to a printing apparatus and a printing data producing method, and specifically, to a printing apparatus performing printing in which gradation levels of a print image are expressed by a combination of different sizes of printed dots and production of printing data used in such printing apparatus.

2. Description of the Related Art

As a representative of such a printing apparatus, an ink jet printing apparatus that prints an image by applying inks of the same color and of a plurality of different ejection amounts is known. Printing data used in this ink jet printing apparatus is obtained through a conversion of image data which expresses gradations in a multi-level form (for example, 0–255 by 8 bits) into final ejection data in a binary level form, for each pixel. For example, the image data is, based on a value shown thereby, converted into pattern data of plural bits which expresses the gradation of one of several levels and further index patterns, which express predetermined dot arrangements for respective levels expressed by the pattern data, are used to obtain the binary ejection data for forming dots of the arrangement. Thus, the gradation and maximum density of a printed image can be set by determining the index patterns appropriately.

For example, in a configuration that the image data of 256 gradation levels 0–255 is converted into the pattern data of 4 bits (expressed as 0000-0101 of 4 bits) which expresses one of 9 values (levels 0–8), and the converted pattern data is converted into the binary data by using the index pattern corresponding to the converted pattern data, the index patterns are set so that large and small dots are arranged correspondingly to the respective 9 levels. Thus, the multi-value image data can be converted into the ejection data (binary data) for each nozzle of a printing head, which corresponds to a large or small size of an ink droplet ejected from the printing head.

The index pattern is one of the factors that determine characteristics of a printed image, such as a gradation image. In general, since a highlight portion of the printed image appears to be more granular when a relatively large amount of ink is used in this portion, the index patterns are such that, for example, smaller dots are arranged up to one of the nine levels which corresponds to an intermediate gradation range and larger dots start to be arranged at the next higher level corresponding to the next larger gradation value.

However, the index patterns are such that the arrangements of larger and smaller dots are uniformly determined therebetween correspondingly to pattern data and the larger and smaller dots are uniformly assigned to each level over the range of gradation values that can be expressed by image data. Accordingly, it is likely that only smaller dots are arranged at levels with smaller gradation values.

As a result, in a highlight portion of the image or an intermediate gradation portion with a higher density than that of the highlight portion, which portions are expressed by levels with only such smaller dots arranged thereat, the following problems may occur. Since a relatively small amount of ink (small droplet) forming small dots has relatively low kinetic energy induced by ejection, vibration of a mechanical portion associated with a printing operation or an air stream occurring when the printing head moves may cause an ejecting state of the small droplet to be disturbed (that is, biased), thereby causing deviation of positions of dots formed. This deviation is recognized as a decrease in quality of the printed image. In particular, since the intermediate gradation portion has a higher dot density than the highlight portion, in the former portion, stripes (bands) or the like due to the deviation of the formed dot become more noticeable.

SUMMARY OF THE INVENTION

The present invention can provide a printing apparatus and a printing data producing method which can reduce a degradation in quality of an image printed by forming dots of a plurality of sizes, especially in quality of a highlight or intermediate portion thereof.

In a first aspect of the present invention, there is provided a printing apparatus which uses a printing head provided with printing elements different in a size of dot formed by the printing elements to perform printing on a printing medium, the apparatus comprising:

data producing means for producing printing data corresponding to each of the printing elements of the printing head, different in the size of dot formed, under a predetermined condition; and conversion means for converting the printing data produced by the data producing means into dot data for forming and disposing a dot in a pixel, the conversion means executing the conversion independently for and correspondingly to each of the different sizes of dots.

Here, the predetermined condition for producing the printing data may be a condition that a change in density of an image, which is printed with dots formed based on the printing data corresponding to each of the printing elements different in the size of dot formed, is linear.

In a second aspect of the present invention, there is provided a method of producing printing data used in a printing apparatus which uses a printing head provided with printing elements different in a size of dot formed by the printing elements to perform printing on a printing medium, the method comprising the steps of:

producing printing data corresponding to each of the printing elements of the printing head, different in the size of dot formed, under a predetermined condition; and converting the printing data produced by the data producing step into dot data for forming and disposing a dot in a pixel, the converting step executing the conversion independently for and correspondingly to each of the different sizes of dots.

Here, the predetermined condition for producing the printing data may be a condition that a change in density of an image, which is printed with dots formed based on the printing data corresponding to each of the printing elements different in the size of dot formed, is linear.

According to the above configuration, printing data corresponding to a plurality of printing elements of a printing head, which form different sizes of dots, is produced under a predetermined condition such that an overall change in gradation realized with dots formed by these printing elements is made linear, and therefore, when the produced printing data is converted into dot data for forming the different sizes of dots to be arranged in one pixel, the conversion process can be executed for each of the plurality of the different sizes of dots, without considering the predetermined condition. Consequently, the conversion process can be arbitrarily set for each size of dot under the predetermined condition.

Further, larger dots can be arranged at densities equal to or lower than an intermediate value in the range of density values that are expressed by dot formation, thereby enabling larger and smaller dots to be mixed at these densities.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

Figure 1:
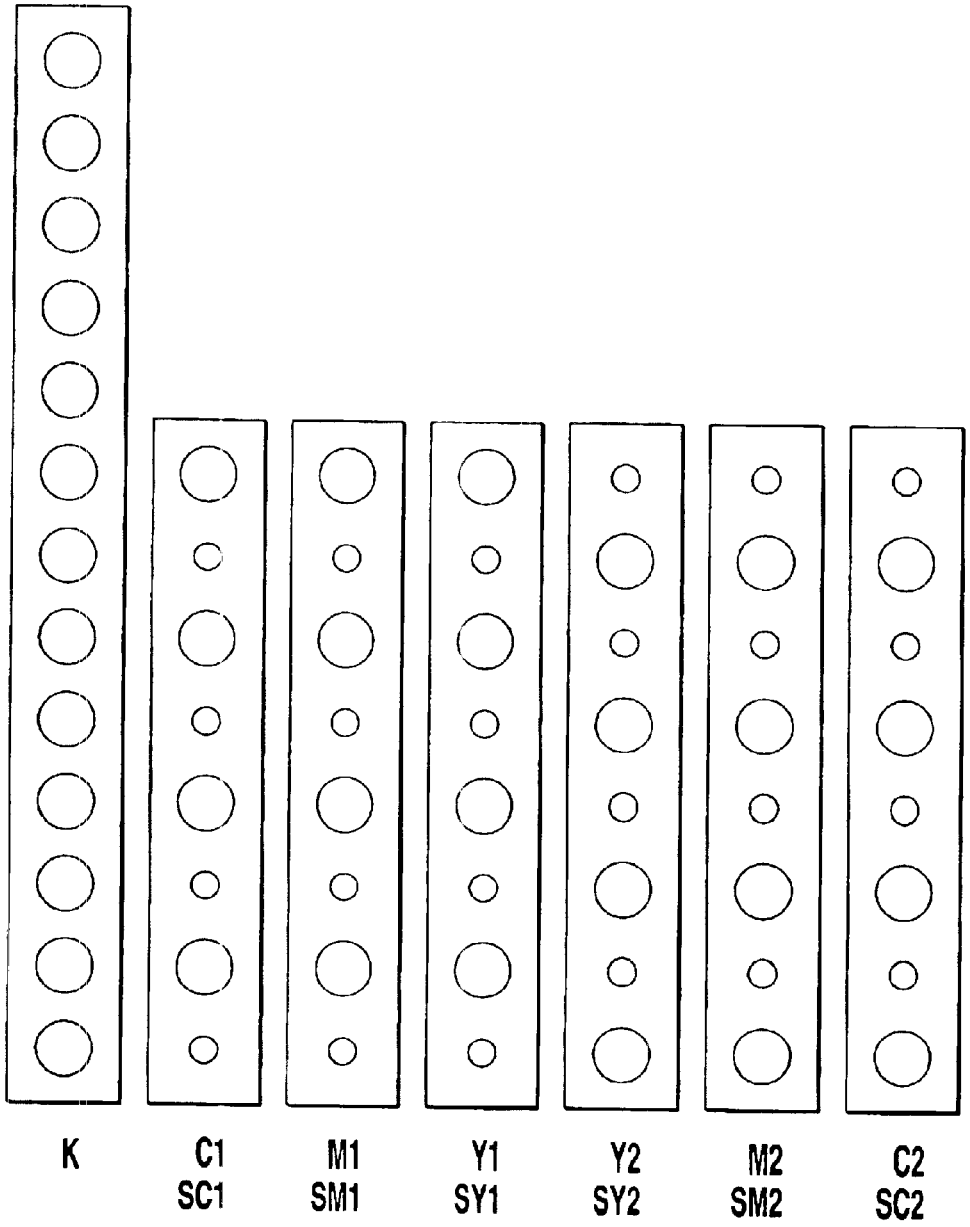
FIG. 1 is a view showing an example of a printing head used in an ink jet printing apparatus according to an embodiment of the present invention.
Figure 2:
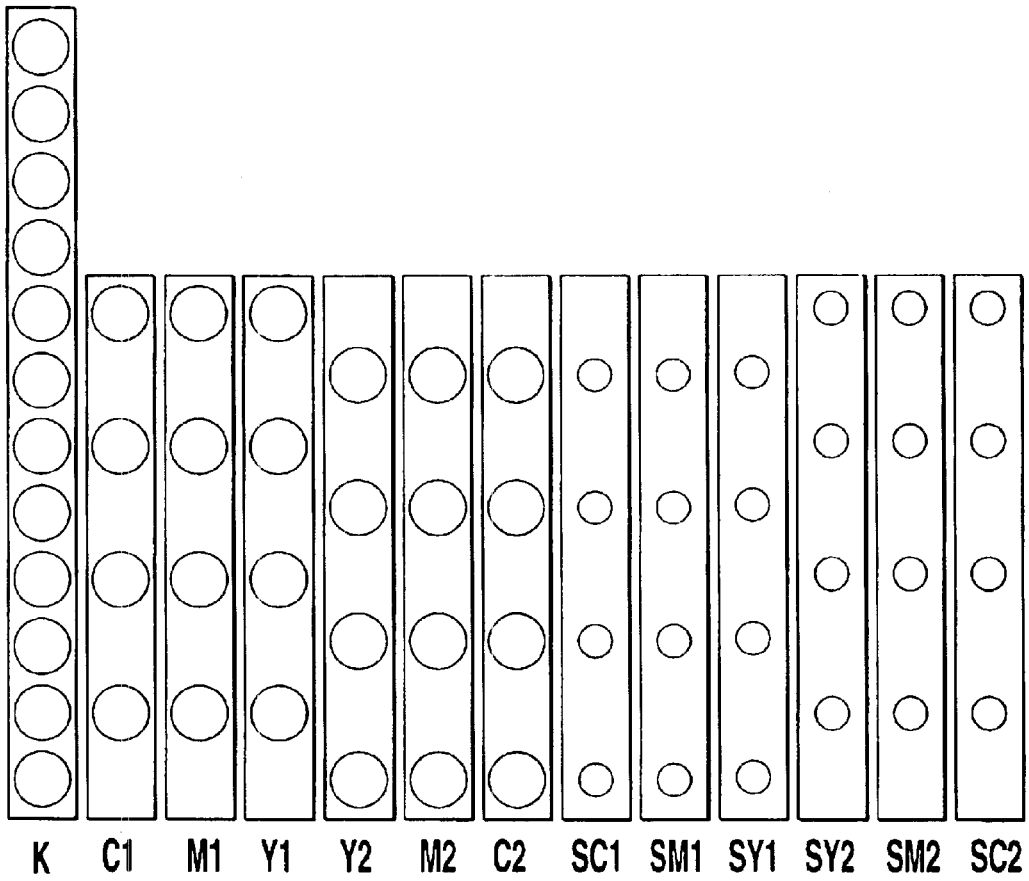
FIG. 2 is a view showing another example of the printing head used in the ink jet printing apparatus according to the embodiment of the present invention.
Figure 3:
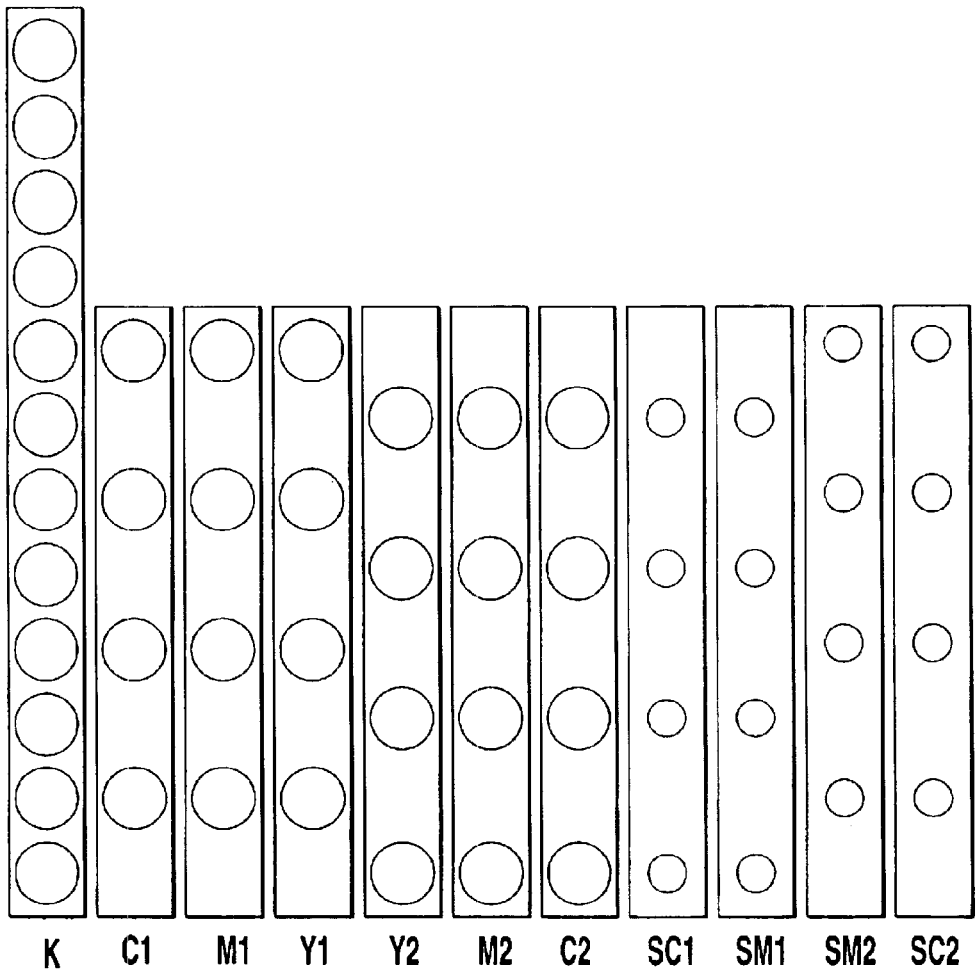
FIG. 3 is a view showing a further example of the printing head used in the ink jet printing apparatus according to the embodiment of the present invention.
Figure 4A:
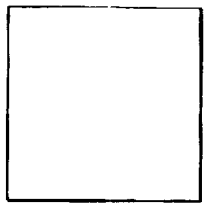
FIGS. 4A to 4E are views schematically showing index patterns used for a conventional printing data producing process.
Figure 4B:
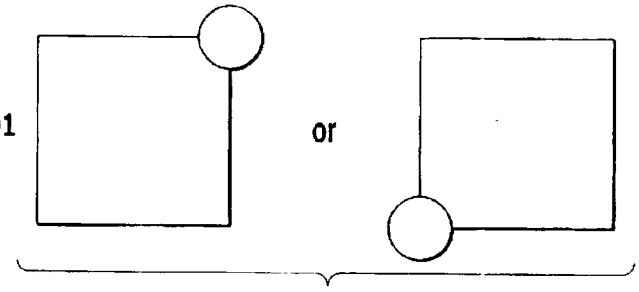
Figure 4C:
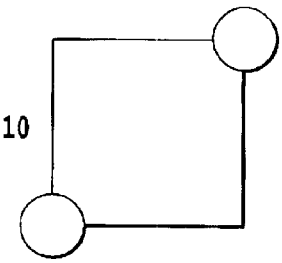
Figure 4D:
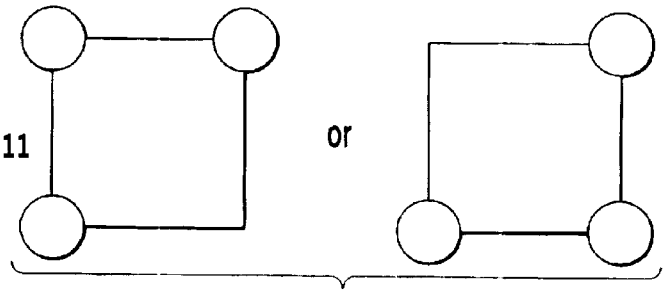
Figure 4E:
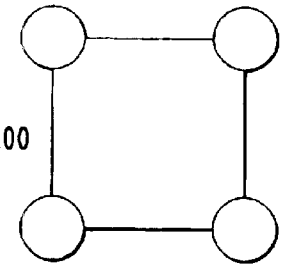
Figure 5A:
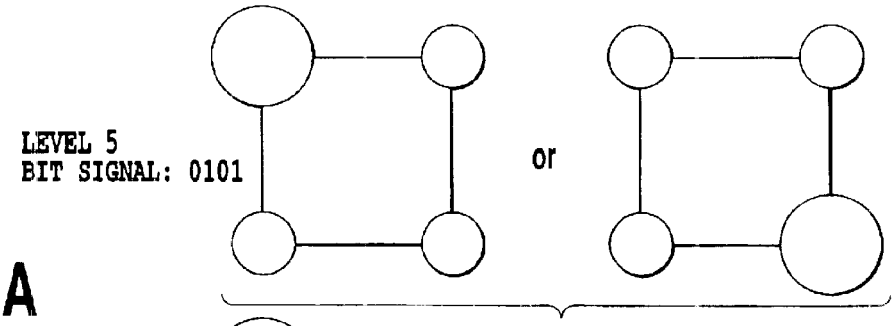
FIGS. 5A to 5D are views similar to FIGS. 4A to 4E and schematically show index patterns used for the conventional print data producing process.
Figure 5B:
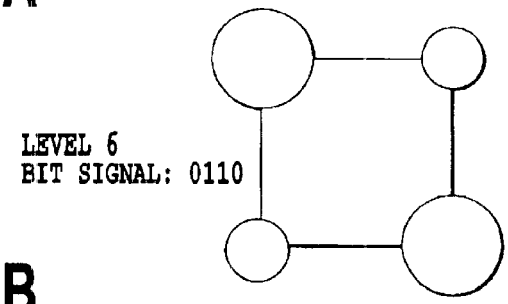
Figure 5C:
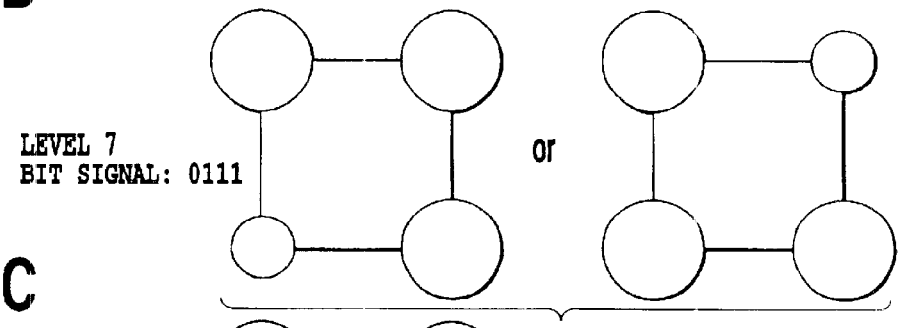
Figure 5D:
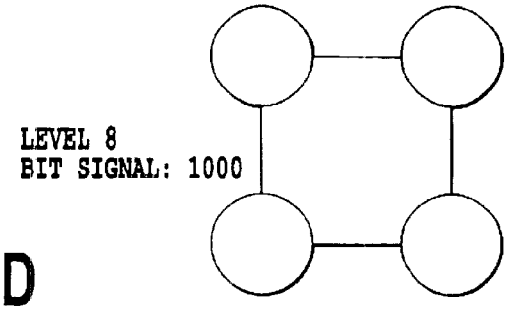

FIGS. 1 to 3 are schematic views showing three examples of an arrangement of ejection openings of a printing head which can be used in an ink jet printing apparatus according to an embodiment of the present invention. As shown in these figures, nozzles (ejection openings), from which different amounts of ink of predetermined colors among inks of cyan (C), magenta (M), and yellow (Y) are ejected, are provided in the same head chip or different head chips. Further, nozzles for black (K) ink are not constructed so as to eject different amounts of ink as in the case with the other colors, and the same amount of ink is ejected from all the nozzles for the ink K. Each nozzle of the head chips is provided with an ejection heater (electro-thermal conversion element) therein for causing a bubble by means of thermal energy generated by the ejection heater so as to eject ink by means of pressure of the bubble. Then, an amount of ejected ink can be differentiated by providing a relatively large ejection heater for a nozzle ejecting the large amount of ink and a relatively small ejection heater for a nozzle ejecting the small amount of ink. It should be noted that as a structure for differentiating the amount of ejected ink, any known structure may be used.

In the example shown in FIG. 1, for each of the C, M, and Y color inks, two head chips are provided and each comprises nozzles from which different amounts of ink are ejected. Specifically, the nozzles from which different amounts of ink of each color are ejected (in FIGS. 1–3, the larger circles represent the nozzles ejecting relatively large ink droplets, whereas the smaller circles represent the nozzles ejecting relatively small ink droplets) are alternately arranged in each of the nozzle rows. The head chip for the black K ink comprises only nozzles from which relatively large ink droplets are ejected. This is to print the black at a high density. The head chips for each ink color each have different nozzles arranged therein and from which different amounts of ink are ejected, but these nozzles share a single heater board portion for each ink color.

In the example shown in FIG. 2, for each of the C, M, and Y color inks, two head chips are provided, each of which has only nozzles from which the larger or smaller ink droplets are ejected. The two heads from which ink droplets of the same color and the same size (amount) are ejected have respective arrangements of nozzles which are offset from each other in a direction perpendicular to a scanning direction of the two heads. Thus, different lines can be printed using the same scan operation.

Further, the illustrated head chips for each color ink are bonded to each other to form an integral printing head.

The example in FIG. 3 has nozzles and head configurations similar to those shown in FIG. 2 except that the yellow heads have only nozzles from which relatively large droplets are ejected. This is because yellow is visually unnoticeable and thus there may be few cases that require smaller dots to be formed.

This embodiment uses one of the above-stated printing beads, each having nozzles from which larger or smaller ink droplets of a predetermined color are ejected, and produce printing data for the respective nozzles as described later in FIGS. 7 to 10.

FIGS. 4A to 4E and FIGS. 5A to 5D are views schematically showing index patterns of 9 levels of the above-described prior art. As described before, image data of 8 bit multi-values is divided into data of 9 levels by using predetermined threshold values to be converted to pattern data of 4 bits corresponding to each level of the 9 levels. More specifically, 8 bits of image data are made to correspond to the pattern data of 4 bits by using the threshold values, which are obtained, for example, so as to divide gradation values 0–255 of the image data into eight equal parts. Then, the pattern data of 4 bits specifies one of index patterns of levels 0–8. Among these index patterns, the index pattern of level 0 is a pattern in which no dot is arranged (a field of white) and the index pattern of level 8 is a pattern having dots disposed on all dot positions to show the highest density.

Figure 6:
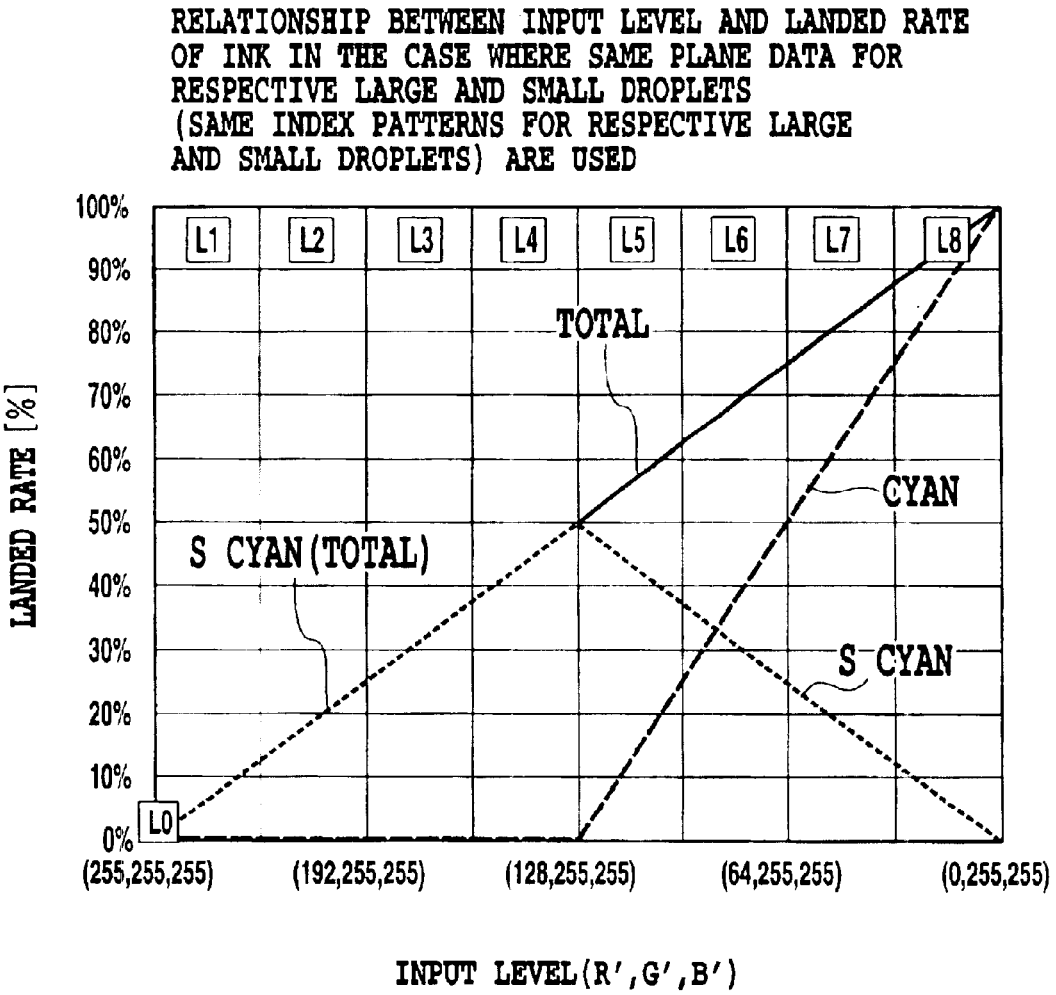
FIG. 6 is a graph showing a relationship between printing data and an ink landed rate in the case where the above index patterns are used.

Further, FIG. 6 is a view showing a relationship between an input level indicated by signals R', G', and B' and a landed rate of ink (a rate at which a pixel is covered with dots formed by landed ink), in a case of using a dot pattern obtained based on the index patterns shown in FIGS. 4 and 5.

As shown in FIGS. 4 and 5, with the index patterns, the pixel is formed only of smaller dots up to level 4, that is, up to an R'G'B' level of 128 shown in FIG. 6, so that the landed rate substantially linearly changes from 0 to 50% to realize smooth gradation. However, even if the landed rate is made to thus linearly change, as described before, since the index patterns are such that larger and smaller dots are uniformly arranged between these different size dots correspondingly to the pattern data and are uniformly assigned at each level over the range of gradation values that can be expressed by image data, only smaller dots are formed up to an input level of 128. As a result of this, the problems such as the appearance of noticeable stripes in the intermediate gradation portion occur, as described before.

On the other hand, it may be considered that contents of the index patterns are adjusted to also dispose larger dots at the intermediate level. However, supposing that the larger dots are disposed at the level at which normally the larger dots are not disposed, since that level corresponds to a relatively low gradation range in a form of the image data as described previously, the larger dots are disposed at a range from the highlight portion to the intermediate gradation, for example. In this case, if the ejection data is produced by using the index pattern disposing larger dots only, without considering gradation characteristics, a problem that the highlight portion appears to be more granular may occur. Further, if changing the threshold values, which determine a correspondence between the image data and each level of the index patterns, in order to dispose the larger dots at the intermediate range, discontinuance of print density may occur at changes of the index pattern and the smooth gradation cannot be realized.

Figure 7:
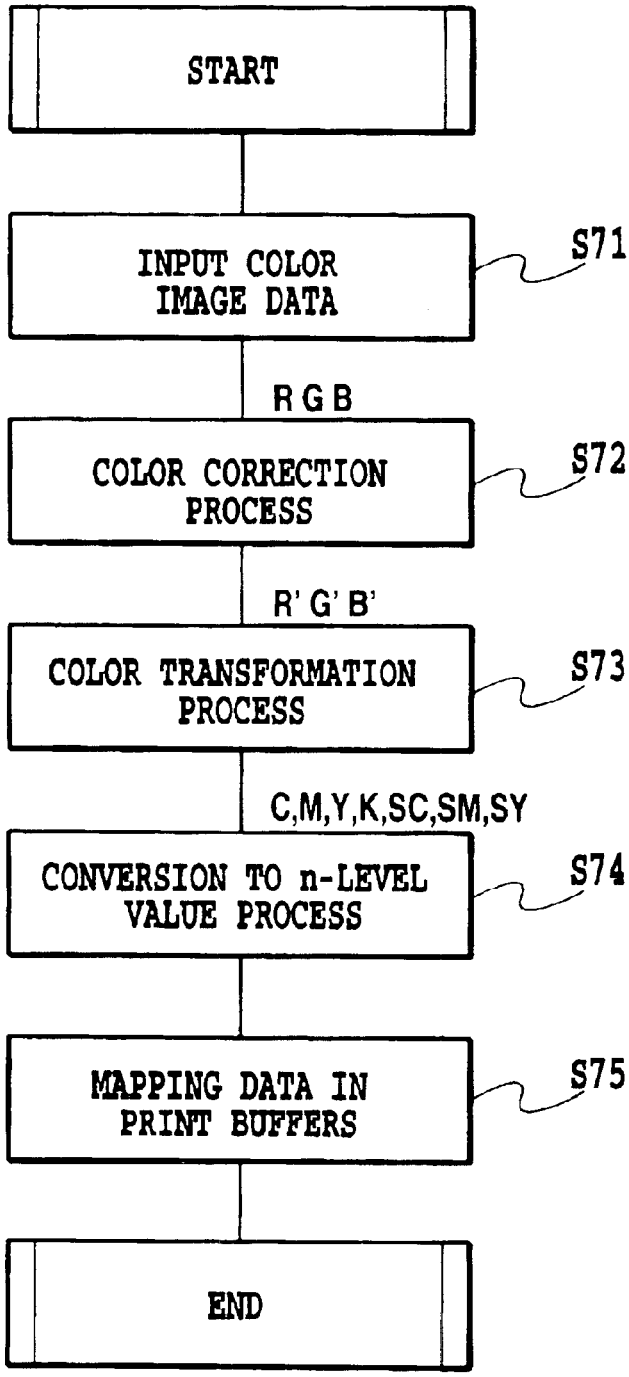
FIG. 7 is a flow chart showing a printing data producing process according to the embodiment of the present invention.

In this embodiment, the arrangements of dots can be relatively easily changed while keeping the smooth gradation, by using the following configuration:

FIG. 7 is a flow chart showing a printing data producing procedure according to this embodiment. It should be noted that a host apparatus may execute the printing data producing procedure to obtain binary data (ejection data) and transfer this data to the printing apparatus.

When a host computer executes a process for a color image and then transfers the image data as a result of the processing to this apparatus, a process of inputting signals R, G, and B is executed at step S71. Then, at step S72, these signals are subjected to a color correction process to obtain signals R', G', and B' of 8 bits.

Furthermore, at step S73, a color transformation process is executed. More specifically, the image data R' G' B', which is image data of a color space formed by R G B, is converted into image data of a color space formed by C M Y K, which is suitable for ink colors used in the printing apparatus of this embodiment. This process is executed with reference to an LUT (Look Up Table) having C, M, Y and K values already stored therein correspondingly to the R', G' and B' input signals.

Figure 8:
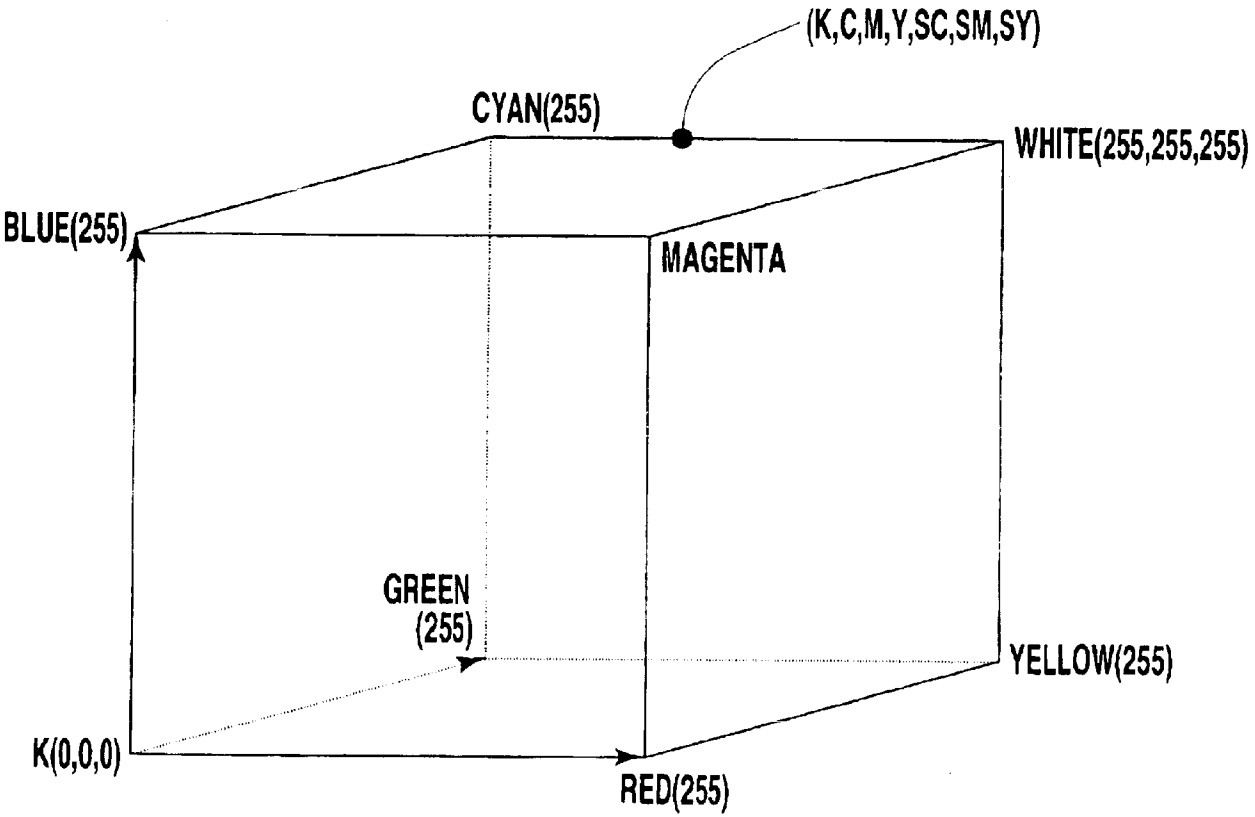
FIG. 8 is a view schematically showing a look up table used for a color transformation process in the printing data producing process.

FIG. 8 is a view schematically showing contents of the LUT. As shown in this figure, the LUT of this embodiment outputs, for each the colors C, M and Y, data SC, SM and SY corresponding to smaller ink droplets as well as data C, M and Y corresponding to larger ink droplets, as transformed data. Specifically, data K, C, M, SC, SM and SY stored, as described later for FIG. 10A, correspondingly to combinations of values of the data R', G' and B' are output.

Then, at step S74, a conversion to n-value process is executed on the image data K, C, M, SC, SM and SY of 8 bits obtained by the color transformation process. In this embodiment, the conversion to n-value process is executed for each color image data to obtain 5-value data. This conversion to 5-value process provides data of 4 bits (0000-0100) and then binary data for ink ejection can be obtained based on index patterns corresponding to these 5 values. That is, as described in detail in FIG. 9, ejection data for each nozzle can be obtained which causes larger and smaller ink droplets of each color ink to be ejected to form a 2×2 dot pattern, for each pixel. The data thus obtained is mapped in a print buffer at step S75. Further, a method of obtaining the binary data for ejection from the image data K, C, M, SC, SM and SY of 8 bits is not limited to the above method using the index pattern. Any known methods of obtaining the binary data from 8 bit data may be used, as long as these methods are executed independently for each of the larger and smaller ink droplets.

Figure 9:
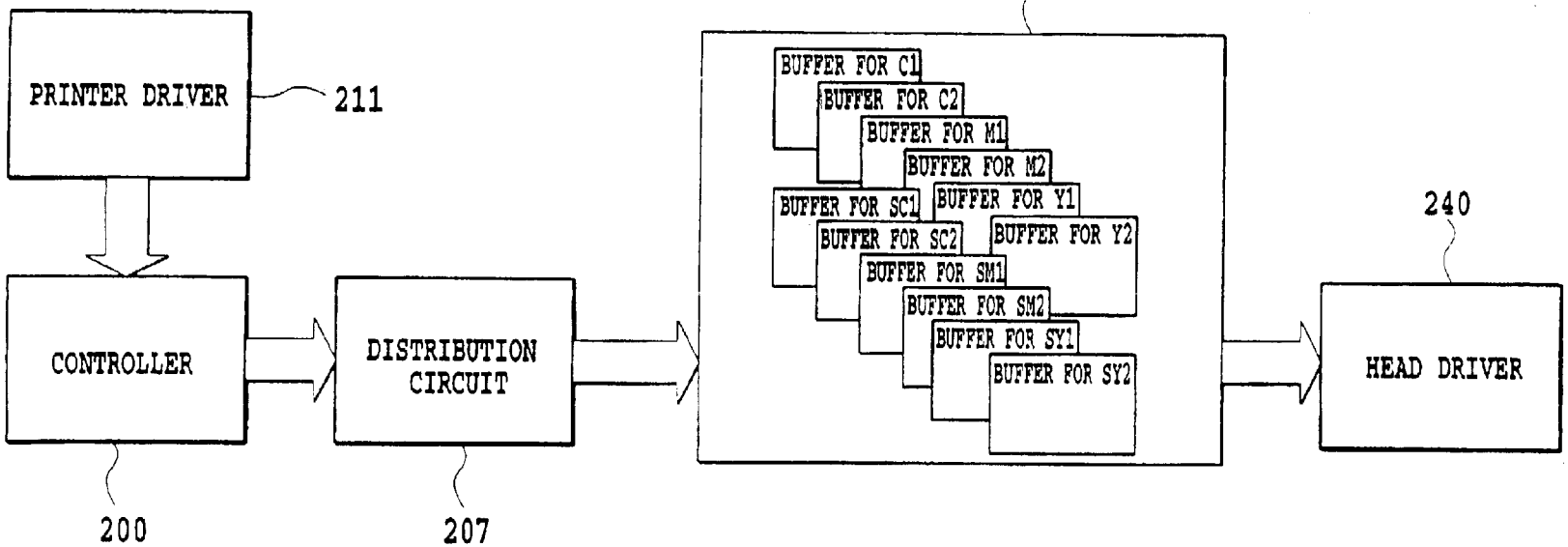
FIG. 9 is a view useful in describing a process of storing data obtained through the above data producing process, in a buffer.

FIG. 9 is a view mainly showing a configuration of the print buffer of this printing apparatus.

A print driver 211, shown in this figure, is software for producing the image data in a host apparatus and for transferring the produced data to this printing apparatus.

A controller 200 of the printing apparatus of this embodiment causes a distribution circuit 207 to write data K, C, M, Y, SC, SM and SY for each pixel, obtained through steps S71 to S74, to corresponding print buffers 205 as 2-bit data for each color (step S75).

More specifically, for example, upon writing, for data of the cyan C, 2-bit data to one pixel of 360 dpi, in this embodiment, a total of 4 bits are written to the corresponding print buffers, that is, respective 2 bits are written to respective buffers C1 and C2 corresponding to nozzles C1 and C2, respectively, of larger ink droplets. By this distribution process, for each of two nozzles C1 and C2 for ejecting the larger ink droplets, 0–2 ink droplets of ejection is set for one pixel and then a total of 0–4 larger ink droplets of ejection can be set. Similarly, for the data SC corresponding to smaller cyan ink droplets, a total of 4 bits are written to the print buffers, that is, 2 bits are written to each of the buffers SC1 and SC2 for nozzles SC1 and SC2 for smaller ink droplets to set 0–4 smaller ink droplets of ejection. As the arrangement of the nozzles for ejecting the larger and smaller ink droplets, any of the arrangements shown in FIGS. 1 to 3 can be used. Then, by using two nozzles apart from each other at one nozzle pitch in the arrangements, for printing each pixel, the 2×2 dot pattern disposing larger and smaller dots can be formed during a single scan operation. On the basis of the thus produced data, a head driver 240 drives each head to eject the corresponding ink.

More specifically, when the nozzles of the head reach a pixel position at which the inks are to be ejected from the nozzles, the data in the corresponding buffers is loaded into registers in the head to execute an ejection operation of the corresponding inks. Thereby, the respective dot arrangements for the larger and smaller ink droplets can be realized independently, for example, as shown in FIGS. 4A to 4E.

Figure 10A:
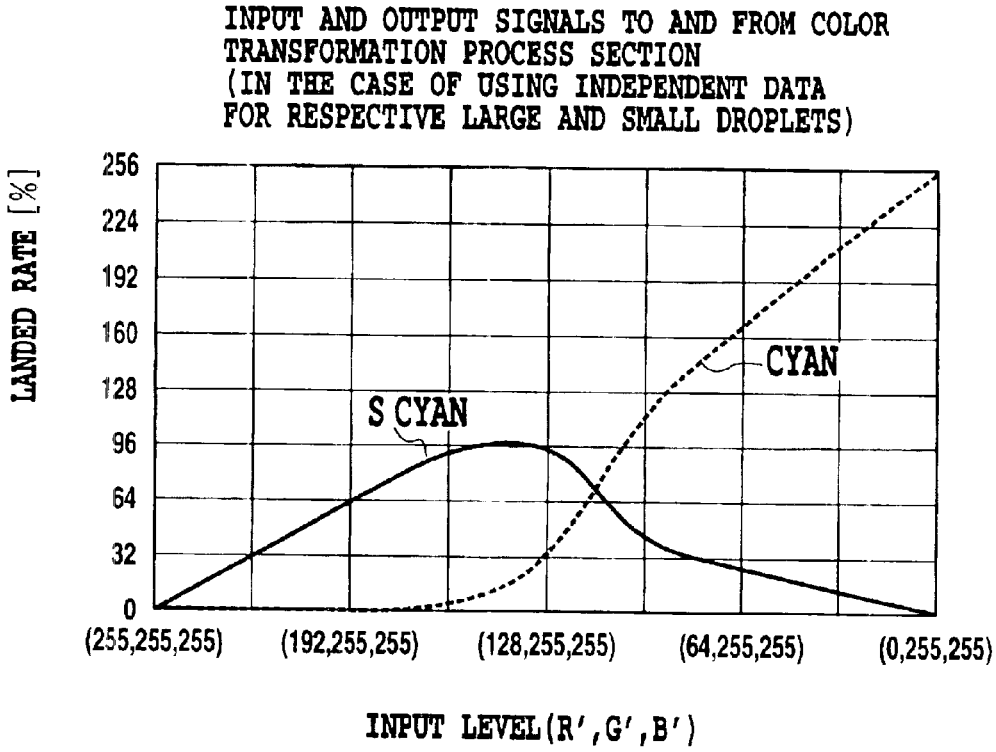
FIGS. 10A and 10B are graphs showing a relationship between an input level and a landed amount of ink in the case where printing data for causing different amounts of ink of the same color to be ejected are independently formed correspondingly to the size of droplets.
Figure 10B:
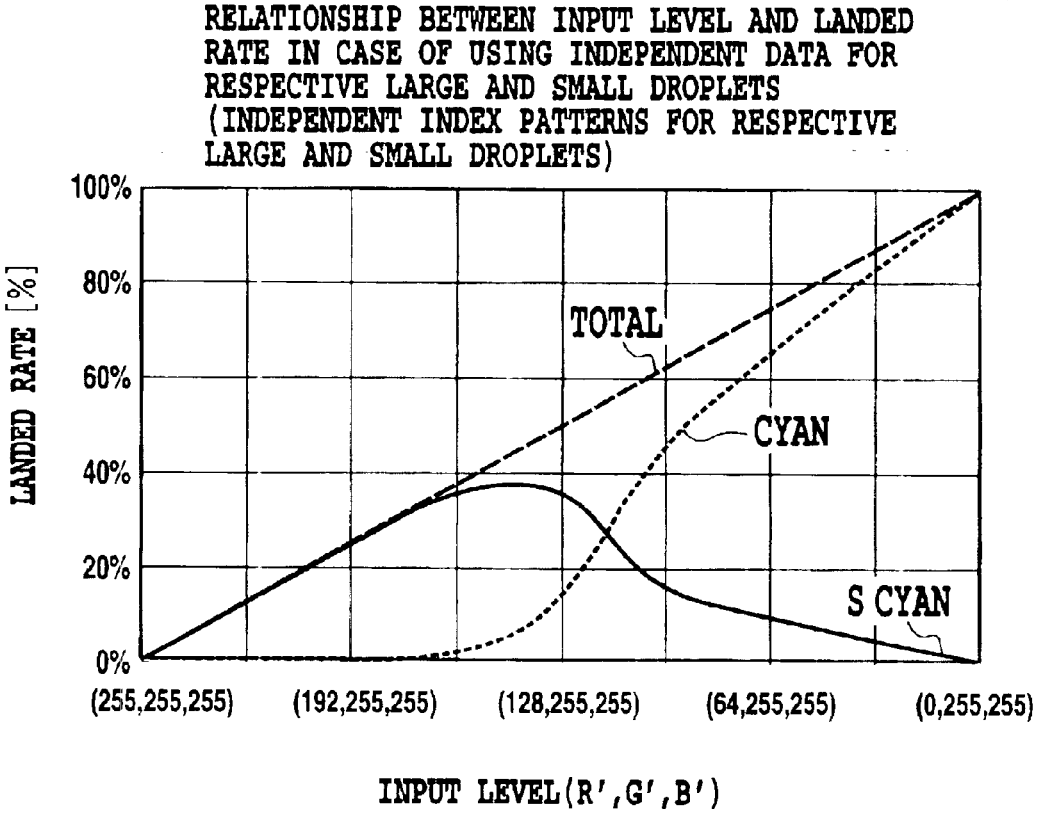

FIGS. 10A and 10B show a relationship between an input level and a landed amount of ink in the case where the printing data causes different amounts of ink of the same color to be ejected and is independently formed for each size of droplets.

Specifically, FIG. 10A is a view for explaining the transformation by the table shown in FIG. 8 by way of an example, which shows converted outputs for the colors C and SC among the outputs which correspond to inputs for the colors indicated by points on the CYAN-WHITE axis in the table. FIG. 10B is a view showing the ink landed rate finally obtained correspondingly to the values of the inputs.

As shown in FIG. 10A, setting of the table is such that the data C corresponding to the larger ink droplet is made present at the intermediate gradation value of 128 or larger (a left side of the center of the figure; for density gradation, 128 or less), and a total by adding the data C and the data SC corresponding to the smaller ink droplet is set to show linear gradation change as shown in FIG. 10B. These contents of the table can be set by previously executing a simulation or an experimentation of printing. Thus, the larger ink droplets can be used in the intermediate gradation area, thereby enabling an image to be printed by mixing the larger and smaller ink droplets together in this area. As a result, even if an ejection path of the smaller ink droplets is deviated, the larger ink droplets having higher kinetic energy stably land on a printing sheet, thereby making it difficult to perceive possible stripes.

Further, the thus obtained respective printing data of 8 bits for the larger and the smaller ink droplets is, as described before, made to be printing data of 4 bits corresponding to two respective nozzles, for each pixel by means of the conversion to 5-value process. An arrangement pattern of the larger and smaller ink dots (contents of the index pattern in this embodiment) determined by this converted data of 4 bits can be adjusted independently for the respective larger and smaller dots. Specifically, as described above, the color transformation table (LUT) shown in FIG. 10A is determined under a restriction condition that the total relationship shown in FIG. 10B is linear. Accordingly, any of the arrangement patterns satisfying values of data K, C, M, Y, SC, SM, and SY obtained through the color transformation table can arbitrarily have sizes of dots and positions thereof. In other words, the conversion to n-value process in step S74 shown in FIG. 7 can be executed independently for the larger ink droplets and the smaller ink droplets, to independently determine the dot arrangement. As a result, the dot arrangement corresponding to each gradation level of the image data can be easily adjusted and printing applying the larger ink droplets at the intermediate density gradation or less can be performed.

Furthermore, even if, in a design, a relative balance between the amounts of ink droplets changes, this can be easily dealt with simply by changing the contents of the look up table for the color conversion process or of the n-value conversion process.

Figure 11:
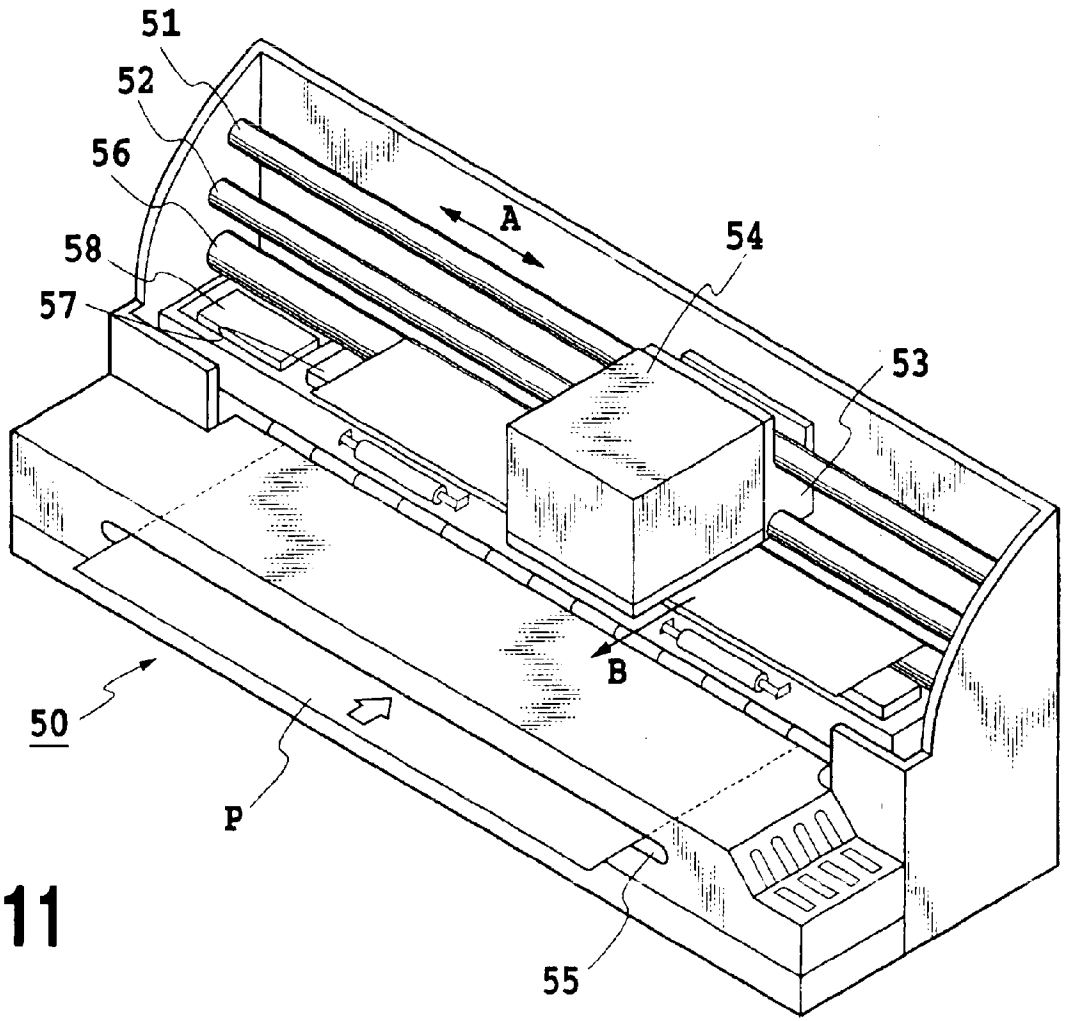
FIG. 11 is a perspective view showing a general structure of an ink jet printing apparatus according to one embodiment of the present invention.

FIG. 11 is a perspective view showing a generic structure of the ink jet printing apparatus of the embodiment described above. A printing apparatus 50 of the embodiment is of a serial type and a carriage 53 is guided by the guide shafts 51 and 52 to move in a main scanning direction shown by arrow A. The carriage 53 is, through a driving force transfer mechanism such as a carriage motor, a belt transferring driving force of the motor and the like, capable of being moved reciprocally in the main scanning direction. On the carriage 53, one of the printing heads shown in FIGS. 1 to 3 and ink tanks for respective ink colors are mounted. The printing apparatus and the ink tanks 54 may be a form of an ink jet cartridge in which the printing head and the ink tanks are integrally formed. A sheet P as a printing medium is inserted to an insert opening 55 provided at a front end of the apparatus and then after a feeding direction of the sheet is reversed the sheet is transported by a feeding roller 56 in a sub-scanning direction shown by arrow B. The printing apparatus 50 repeats a printing operation which during moving the printing head in the main scanning direction causes the printing head to eject ink to the sheet P on a platen 57, and a transporting operation which transports the sheet at a distance corresponding to a printing width by the printing head in the sub-scanning direction, alternately, to complete the image on the sheet successively.

At a left end portion, in FIG. 11, of the moving area of the carriage 53, an ejection recovery unit 58 capable of being opposed to an ejection opening forming surface of the printing head is provided. The ejection recovery unit 58 is provided with a cap capable of covering the ejection openings of the printing head, a suction pump for introducing negative pressure in the cap and the like. The unit causes the ink to be discharged from the ejection openings by introducing the negative pressure in the cap covering the ejection openings to perform a recovery operation for maintaining an appropriate ejection state of the printing head. Further, the printing head is also subjected to another ejection recovery operation which causes the ejection openings to eject ink, which is not related to printing, to perform a recovery operation for maintaining an appropriate ejection state of the printing head.

In the above embodiment, the head from which ink is ejected has been described by way of example, but of course the application of the present invention is not limited to this example. The present invention is applicable to any head comprising print elements that can vary the sizes of dots to be formed.

<Other Embodiments>

As described above, the present invention is applicable either to a system comprising plural pieces of equipment (such as a host computer, interface device, a reader, and a printer, for example) or to an apparatus comprising one piece of equipment (for example, a copy machine or facsimile terminal device).

Additionally, an embodiment is also included in the category of the present invention, wherein program codes of software such as those shown in FIGS. 13 and 15, for example, which realize the above described embodiments, are supplied to a computer in an apparatus or a system connected to various devices to operate these devices so as to implement the functions of the above-described embodiments, so that the various devices are operated in accordance with the programs stored in the computer (CPU or MPU) of the system or apparatus.

In this case, the program codes of the software, for example, shown in FIG. 7, themselves implement the functions of the above-described embodiments, so that the program codes themselves and means for supplying them to the computer, for example, a storage medium storing such program codes, constitute the present invention.

The storage medium storing such program codes may be, for example, a floppy disk, a hard disk, an optical disk, a magneto-optical disk, a CD-ROM, a magnetic tape, a non-volatile memory card, or a ROM.

In addition, if the functions of the above-described embodiments are implemented not only by the computer by executing the supplied program codes but also through cooperation between the program codes and an OS (Operating System) running in the computer, another application software, or the like, then these program codes are of course embraced in the embodiments of the present invention.

Furthermore, a case is of course embraced in the present invention, where, after the supplied program codes have been stored in a memory provided in an expanded board in the computer or an expanded unit connected to the computer, a CPU or the like provided in the expanded board or expanded unit executes part or all of the actual process based on instructions in the program codes, thereby implementing the functions of the above-described embodiments.

According to the embodiments of the present invention, printing data, corresponding to a plurality of printing elements of a printing head, which form different sizes of dots, is produced under a predetermined condition such that an overall change in gradation realized with dots formed by these printing elements is made linear, and therefore, when the produced printing data is converted into dot data for forming the different sizes of dots to be arranged in one pixel, the conversion process can be executed for each of the plurality of the different sizes of dots, without considering the predetermined condition. Consequently, the conversion process can be arbitrarily set for each size of dot under the predetermined condition.

Further, larger dots can be arranged at densities equal to or lower than an intermediate value in the range of density values that is expressed by dot formation, thereby enabling larger and smaller dots to be mixed at these densities.

As a result, for example, even if landed positions of the smaller amount of ink droplets are deviated on the sheet or are otherwise affected, the disturbance of the image can be restrained. Further, the image is affected if the dot arrangement is unnaturally switched (unnatural junction) in using the index pattern of the prior art, but the present invention allows the arrangement to be easily changed simply by changing the output table or the like, thereby improving the degree of freedom of the design.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus which uses a printing head provided with printing elements, differing in sizes of dots formed by said printing elements, to perform printing on a printing medium, said apparatus comprising:

data producing means for, based on image data, producing printing data corresponding to each of the printing elements under a predetermined condition through a color transformation process transforming the image data to the printing data, the printing elements differing in the sizes of dots to be formed; and conversion means for converting the printing data produced by said data producing means into dot data for distributing a dot to a pixel, said conversion means executing the conversion independently for and correspondingly to each of the different sizes of dots.

2. A printing apparatus as claimed in claim 1, wherein the predetermined condition for producing the printing data is a condition that a change in density of an image, which is printed with dots formed based on the printing data corresponding to each of the printing elements differing in the sizes of dots formed, is linear.

3. A printing apparatus as claimed in claim 2, wherein said conversion means converts the printing data into the dot data that applies a large size of dot in a density range equal to or less than an intermediate value in a range of density values that are expressed by dot formation.

4. A printing apparatus as claimed in claim 3, wherein the printing elements include ink ejection openings for ejecting ink.

5. A printing apparatus as claimed in claim 4, wherein the printing head arranges the ejection openings that eject ink of a same color and different ejection amount in parallel and in a scanning direction of the printing head, and is used for forming the dots differing in size by means of the ejection openings ejecting ink differing in ejection amounts.

6. A printing apparatus as claimed in claim 5, wherein the printing head arranges a group of the ejection openings of a plurality of ink colors and another group of the ejection openings of the plurality of ink colors symmetrically with respect to an axis perpendicular to the scanning direction.

7. A printing apparatus as claimed in claim 4, wherein the printing head arranges the ejection openings that eject ink of a same color and different ejection amount alternately in a direction perpendicular to a scanning direction of the printing head, and is used for forming the dots differing in size by means of the ejection openings ejecting ink differing in ejection amounts.

8. A printing apparatus as claimed in claim 4, further comprising a plurality of print buffers, corresponding to respective inks of different ejection amounts and of a same color, for storing the dot data selectively in the plurality of buffers so as to eject ink from the corresponding ejection openings.

9. A printing apparatus as claimed in claim 1, wherein the image data is defined as R, G, B data and the printing data is defined as Y, M, C data.

10. A method of producing printing data used in a printing apparatus which uses a printing head provided with printing elements, differing in sizes of dots formed by said printing elements, to perform printing on a printing medium, said method comprising the steps of:

producing, based on image data, printing data corresponding to each of the printing elements under a predetermined condition through a color transformation process transforming the image data to the printing data, the printing elements differing in the sizes of dots to be formed; and converting the printing data produced by said data producing step into dot data for distributing a dot to a pixel, said converting step executing the conversion independently for and correspondingly to each of the different sizes of dots.

11. A method as claimed in claim 10, wherein the predetermined condition for producing the printing data is a condition that a change in density of an image, which is printed with dots formed based on the printing data corresponding to each of the printing elements differing in the sizes of dots formed, is linear.

12. A method as claimed in claim 11, wherein said converting step converts the printing data into the dot data that applies a large size of dot in a density range equal to or less than an intermediate value in a range of density values that are expressed by dot formation.

13. A method as claimed in claim 12, wherein the printing elements include ink ejection openings for ejecting ink.

14. A method as claimed in claim 10, wherein the image data is defined as R, G, B data and the printing data is defined as Y, M, C data.

15. A program for causing an information processing apparatus to execute a printing data producing process, which produces printing data used in a printing apparatus which uses a printing head provided with printing elements, differing in sizes of dots formed by said printing elements, to perform printing on a printing medium, said printing data producing process comprising the steps of:

producing, based on image data, printing data corresponding to each of the printing elements under a predetermined condition through a color transformation process transforming the image data to the printing data, the printing elements differing in the sizes of dots to be formed; and converting the printing data produced by said data producing step into dot data for distributing a dot to a pixel, said converting step executing the conversion independently for and correspondingly to each of the different sizes of dots.

16. A program as claimed in claim 15, wherein the image data is defined as R, G, B data and the printing data is defined as Y, M, C data.

* * * * *